United States Patent [19]

Cederqvist et al.

[11] 4,159,224

[45] Jun. 26, 1979

[54] METHOD FOR THE PRODUCTION OF A FIBER COMPOSITE

[75] Inventors: Gunnar Cederqvist, Lerdala; Ulf Åberg, Skövde, both of Sweden

[73] Assignee: Rockwool Aktiebolaget, Skövde, Sweden

[21] Appl. No.: 804,296

[22] Filed: Jun. 7, 1977

[30] Foreign Application Priority Data

Aug. 12, 1976 [SE] Sweden ..... 7609017
Feb. 9, 1977 [SE] Sweden ..... 7701418

[51] Int. Cl.[2] ..... D21H 5/18

[52] U.S. Cl. ..... 162/145; 162/147; 162/189; 162/DIG. 9

[58] Field of Search ..... 162/145, 190, 191, DIG. 9, 162/147, 187, 189

[56] References Cited

U.S. PATENT DOCUMENTS 3,300,372 1/1967 Bauer ..... 162/145
3,379,608 4/1968 Roberts et al. ..... 162/145

FOREIGN PATENT DOCUMENTS 2278839 3/1976 France ..... 162/DIG. 9

*Primary Examiner*—Richard V. Fisher
*Assistant Examiner*—William F. Smith
*Attorney, Agent, or Firm*—Larson, Taylor and Hinds

[57] ABSTRACT

A method for producing shaped bodies of fibrous materials using mineral fibers, cellulosic fibers, and zero fibers. The zero fibers are extremely thin and short cellulosic fibers produced either synthetically or from natural by-products from the cellulose industry. These bodies can be used as substitutes for asbestos fiber products, and display physical properties, such as resistance and rigidity, comparable to the asbestos products. The fibrous materials are produced using an aqueous dispersion of the mineral fibers, cellulose fibers, and zero fibers, whereafter the dispersion is de-watered, shaped and dried.

4 Claims, 1 Drawing Figure

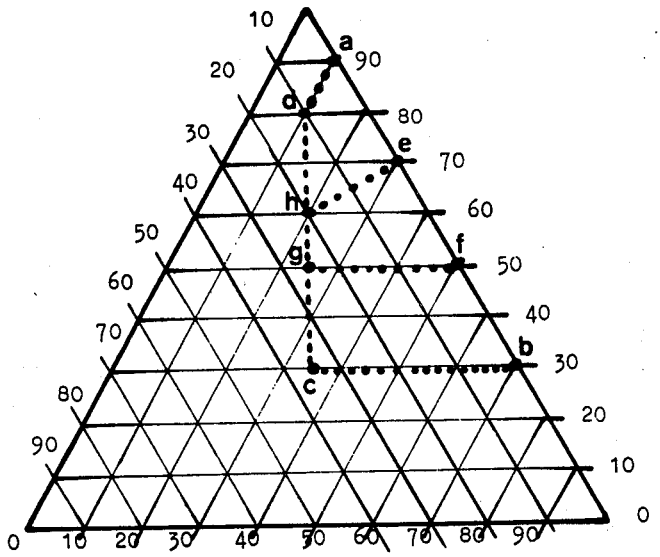
a
b
c
d
e
f
g
h
10
20
30
40
50
60
70
80
90
0

METHOD FOR THE PRODUCTION OF A FIBER COMPOSITE

The present invention refers to a method for the production of shaped bodies of a fiber composition, in which mineral fibers are contained as an essential constituent. These bodies are intended to replace such bodies known previously in which asbestos fibers are contained as an essential constituent.

For many purposes, shaped bodies have been used in which asbestos fibers are contained as an essential constituent. Examples include such planar bodies as support felt for floors, but the invention shall not be limited to this type of shaped body nor to planar bodies. Thus, in the manufacture of certain types of floor material, a support felt has been used, which was porous, and which contained asbestos fibers as an essential constituent.

However, asbestos fibers have proved to create a significant health risk in its production and its subsequent treatment, such that micro particles of asbestos hovered freely in the air and were inhaled by persons involved with the production and the handling of the shaped body. This especially applies to tearing down old houses, in which such an asbestos felt is used. Therefore, there is a tendency to replace, as much as possible, the asbestos fibrous material with some other fibrous material and, initially, mineral fibers of a synthetic type have been viewed as a replacement material. In this connection, the meaning of mineral fibers of a synthetic type is such fibers of mineral, which have been produced by some kind of a spinning procedure, starting from a melt of a natural mineral or a mixture of natural minerals. Several examples include stone wool fibers, slag fibers, glass wool fibers and so on. These types of mineral fibers do not cause the health risks which are created by asbestos fibers.

However, it has proved less successful to replace the asbestos fibers by such mineral fibers, because asbestos fibers, on the one side, and mineral fibers, on the other side, show very different physical properties. Whereas asbestos fibers are uneven and, as seen under the microscope, show barb like formations along their length, the artificial mineral fibers are, as a rule, smooth. Whereas the asbestos fibers will therefore create a strong friction bond, the mineral fibers do not provide for any such friction bond or, at most, they will give only a very weak friction bond.

Replacement of the overly weak friction bond of mineral fibers as compared with asbestos fibers has been attempted by the addition of a binding means, but in these tests it has proved, that such a step is not economically feasible. The amount of binding means will, unavoidably, be rather large, and the binding means, that can be considered are expensive, and therefore, the costs for such a binding means bond product will be too high.

The idea then arose to try mixing in some other type of fibers in combination with the mineral fibers, which might predictably reinforce the bond in the product. Such fibers used in the tests forming the basis of the present invention include rag fibers, cotton fibers, and cellulose fibers, bonded by means of some binding material, available at a reasonable price, such as latex. These tests, however, have not given the desired result, because it has proved, that the products lacked the required dimensional stability under the influence of moisture, heat and especially heat variations.

The present invention, therefore, refers to a method for the production of shaped bodies of a fibrous composition, in which mineral fibers are contained as an essential constituent. The invention has for its purpose the production of a shaped body in which, along with mineral fibers, such materials are contained, that the shaped body will obtain properties which are comparable with the properties of shaped bodies produced from asbestos fibers for the same purpose, especially planar bodies. The said properties, primarily, are: resistance to moisture, heat and variations in heat as well as rigidity in all different directions, in which the shaped body may be subjected to strains.

In the tests forming basis of the present invention, it has been established that, due to the typical tendency of mineral fibers to be positioned in parallel levels, there is a tendency in the different test products to burst, resulting in layer separation or slotting which characterizes a lack of rigidity in a direction perpendicular to the level of the shaped body. In addition, the rigidity was sometimes dissatisfactory in other directions.

For the rigidity in a direction perpendicular to the main level of a plane shaped body, the term "splitting rigidity" has been introduced, or "z-rigidity." This latter expression is derived from the fact that in a planar body, two directions falling in the level of the shaped body have ordinarily been called the x-direction and the y-direction, and it is therefore fitting to call a direction perpendicular to the main level of the shaped body its "z-direction." Good splitting rigidity, of course, is not required in such cases, where the shaped body is not subjected to any strains in the z-direction, but such cases are very unusual. Each bending of the plane shaped body will, in fact, cause such strains and, in many cases, the shaped body must during some step of its production, transportation or use be subjected to bending, for instance if it is driven in a calendar. It is established that a splitting rigidity below 5 kg/cm$^2$ is insufficient, that a splitting rigidity between 5 and 9 kg/cm$^2$ will in some cases but not in all cases be regarded as sufficient, and that a splitting rigidity of more than 9 kg/cm$^2$ has to be regarded as completely satisfactory for all normally existing purposes.

In the tests forming the basis of the present invention, as mentioned above, cellulose fibers have been tried among others as an additional material, but did not give the desired result. Surprisingly, however, it was discovered that one will get exceedingly advantageous properties of the final product if, instead of using the regular cellulose fiber, one uses the by-product in the manufacture of cellulose, which, due to its small dimensions, is called "zero fibers," and which was otherwise regarded detrimental or, in any case, useless.

Previously, "zero fibers" were disclosed as the extremely thin and short cellulose fibers which pass through a usual vira or wire and are found in the dewatering water, or so-called back water, and which were there regarded as an impurity. These zero fibers are thus separated either not at all or only to an insignificant degree during the dewatering through the vira, such that they remain as freely hovering particles in the water, usually only visible to the human eye as a muddiness. Of course, they may be separated by different kinds of separation steps, such as centrifugation. They were hitherto regarded as a dangerous by-product within the cellulose industries, and even presented a difficult disposal problem. Letting out zero fiber containing dewatering water has caused serious environmental problems.

These zero fibers should, for reasons which will be evident from the following, be free of such impurities, which may act to decrease the rigidity of the final product. Among such impurities, primarily are certain dyestuffs, which are normally used when coloring cellulose on a vira for the production of paper, colored throughout. Where there is no access to pure natural zero fibers, however, such fibers may be produced synthetically as will be described herein below.

The present invention is based upon the observation that mixing in this cheap product, viz. natural or synthetic zero fibers from the cellulose industry, will create such a good bond between the mineral fibers, that the product comprising such zero fibers from the cellulose industry and mineral fibers will obtain physical properties, especially regarding resistance and rigidity, which are completely comparable with the corresponding properties of asbestos fiber products. It is believed that this results from the normal cellulose fibers being so long, that they will preferentially arrange themselves in the same sheeting pattern, established by the mineral fibers, and that for this reason, products in which such usual cellulose fibers are contained do not show especially advantageous properties, particularly regarding splitting rigidity, whereas, in contrast, the zero fibers are so short that they lack the power of arranging themselves in a sheeted pattern such that they will therefore contribute to an improved bond.

The best bond, however, is obtained when using zero fibers as well as usual cellulose fibers in a defined quantitative distribution for mixing in material in the mineral fiber mass. The tests forming the basis of the invention, therefore, had for their purpose to establish the proportions between the different types of fibers, whereby the most favorable properties will be obtained in the shaped bodies produced.

It has been established that when using ordinary cellulose fibers in a mixture with zero fibers as an addition to the mineral fibers, that the amount of zero fibers within the total amount of cellulose fibers should be at least one-half part, and preferably even more than one-half part. It may happen that a sufficient quantity of zero fibers of cellulose material may not be available, and in such a case, usual cellulose fibers may be finely divided synthetically so that they will obtain the same properties as zero fibers. Of course, there is nothing to prevent that in the usual cellulose fibers there may be contained residual amounts of zero fibers. Preferably, also, both the usual fibers and the zero fibers of cellulose material should be of the so called Kraft fibers used in the production of Kraft paper.

Previously, zero fibers were not used for industrially technical purposes, and the separation of them from the back water within the cellulose industry, therefore, has been considered an additional expense. Since a potential industrial use of the zero fibers has now, by the present invention been advanced, the separation of the zero fibers from the back water will probably take place to an increased extent.

The mineral fibers may be of any deliberate type known per se but it would be an advantage if they are as far as possible free from the larger accumulations of molten mineral, or so called pearls. It is especially suitable that the mineral fiber material be formed from mineral fibers of stone or glass fibers, but fibers from slag as raw material are certainly possible to use, however, due to their lower rigidity and resistance, they will not give the same good result.

The proportional relation between mineral fibers and cellulose fibers has also been carefully investigated, and it has, thereby been shown that this proportional relation may, under certain circumstances be rather critical and that the correct proportional relation must be the result of a compromise. As a matter of fact, it has been shown that a given minimum quantity of cellulose is required in order to get a satisfactory wet rigidity, which is necessary due to the production method of the shaped bodies, which will be further described below, and this especially applies to the initial part of the production process. Without such a wet rigidity the product cannot for instance, be driven through a paper machine. Further, a given minimum quantity of cellulose material is required such that the ready product will obtain a satisfactory rigidity, especially against splitting, which is defined as bursting under the influence of forces acting substantially perpendicularily to the level of the shaped body. This especially applies to shaped bodies in the form of sheets, discs and similar thin shaped bodies, and for said products it is necessary to prevent delamination or splitting, and for said purpose a given minimum quantity of cellulose material is also required. These circumstances therefore are in favor of a high content of cellulose material. At too high a content of cellulose material, however, instead a dimensional instability will be introduced. For these reasons, the proportions of mineral wool and of cellulose material must be found by a compromise method. The result of extensive investigations for finding this compromise has been that the participation of mineral fibers should not be more than 90 percent by weight and preferably not more than 70 percent by weight of the total amount of fibers, and also not be less than 30 percent by weight of the total amount of fibers.

The invention thus refers to a method for the production of shaped bodies and preferably planar bodies of a fibrous composition, in which mineral fibers are contained as an essential constituent along with cellulose fiber material.

According to the invention, a dispersion is prepared in water using mineral fibers and cellulose material, wherein at least one-half but preferably more than one-half and up to about 78% by weight of the cellulose fiber material consisting of zero fibers. The dispersion is thereafter dewatered.

To a fibrous composition as disclosed above, certain additions may be made for different purposes. Wetting means is one such addition, preferably a cationically acting wetting means. Other additions may comprise glue, filler and/or thickening means. Wetting means may be of great use for promoting an even distribution of material in the dispersion, because the mineral fibers would otherwise form pellets. Glue may also be used in such cases when, in such cases, the binding action from the cellulose fiber material is not sufficiently strong. As filler one may use finely ground diatomaceous stone, clay, bentonite or other finely divided, inorganic constituents, which should be chemically inactive against both the mineral fibers and the cellulose material. The thickening means may be of any deliberate kind known per se and may be advantageous, because it may otherwise be difficult to treat the mass in moist stage.

When preparing the ready product, one proceeds substantially in the following way:

First, a fiber dispersion in water is produced, and this is dewatered. Either simultaneously with the dewatering or in sequence thereafter, the products are shaped from this dispersion, and thereafter they are dried. In preparing the dispersion one may add such addition, as may be desired, as mentioned above. In the usual case, the dewatering takes place on a vira, for instance a plane vira; however, one may, in principle, use any method known for dewatering. The shaping, also, preferably takes place on the same vira, when the final product is to have a planar body, but as the shaped body is of a more complicated type, the shaping suitably takes place by moulding after the dewatering has, at least in part, been completed in perforated moulds. It has been established that the presence of mineral fibers in the dispersion enables dewatering to occur much more easily, as well as producing a shaped body that does not have any shrinking tendency.

The characteristic property of the invention will be clarified below in connection with the drawing which is a triangular chart showing the percentages of the three principal components of the present composition. In the figure, the weight percentage content of zero fibers is plotted along the horizontal scale, the content of such cellulose fibers, which cannot be said to be zero fibers, is plotted along the left sloping scale, and the content of mineral fibers is plotted along the right sloping scale. All of the indicated percentage values thus are percents by weight.

In the diagram, a number of different compositions have been marked, and they have thereby been indicated by a-h. The compositions displayed are as follows:

| Composition | Content of Mineral Fibers | Content of zero fibers | Content of other cellulose fibers |
|---|---|---|---|
| a | 90 | 10 | 0 |
| b | 30 | 70 | 0 |
| c | 30 | 35 | 35 |
| d | 80 | 10 | 10 |
| e | 70 | 30 | 0 |
| f | 50 | 50 | 0 |
| g | 50 | 25 | 25 |
| h | 60 | 20 | 20 |

As seen from the diagram, the eight compositions indicated above describe two irregular four edged figures, the one of them being inscribed in the other one. The invention will give great advantages with all of the compositions within the four edged figure limited by the points a, b, c and d, but the best results are obtained using compositions, situated inside of the narrower four edged figure e, f, g, and h.

The invention will now be further explained by some examples. In all of these examples zero fiber material was used, which had been formed during the production of cellulose for manufacture of paper without any additions, especially without dyestuffs.

EXAMPLE 1

A fiber suspension was prepared from 50% mineral fibers and 50% Kraft cellulose without any addition of zero fibers. Due to the experiences as stated above, it could be expected that the product derived therefrom should not prove satisfactory in all respects. On a continuous vira a sheet of the said fiber composition was shaped and dewatering simultaneously took place on the vira. The sheet thereafter was dried as much as possible. The rigidity in all directions was dissatisfactory. To increase the rigidity, a binding means in the form of a latex solution in water was added in an amount of 25% of the initial weight of material and the product was again carefully dried to about 95% dry weight of material. Thereby it displayed a surface weight of 300 gr/m$^2$, and it showed a good evenness of surface, a good pulling rigidity and a good tearing rigidity. The splitting rigidity against strains in a direction perpendicular to the plane of the product, on the contrary, was completely dissatisfactory, and as a matter of fact, was only 3.2 kg/cm$^2$. The product produced therefore was classified as less satisfactory which was to be expected.

EXAMPLE 2

A fibrous composition was prepared in the same way as in example 1 above, however with the difference, that all of the quantity of cellulose fibers comprised zero fibers. It was expected that a bad rigidity would be obtained, especially bad wet rigidity because there was no long fibrous Kraft cellulose present. It also proved difficult to dewater the fiber composition on a continuous vira because the product did not withstand, in its wet state, the strains which are unavoidable during such a treatment. This agreed with what was expected due to the results of tests forming the experimental basis of the invention.

EXAMPLE 3

A fibrous suspension was prepared corresponding to the point h in the diagram, comprising 60% of mineral fibers, 20% of zero fibers and 20% of Kraft fibers of cellulose. The product was treated on a vira and by subsequent drying as described in example 1 above, but without any addition of binding means. A plane shaped body was obtained having a surface weight of 300 kg/m$^2$ and with excellent rigidity properties against both pulling and tearing. The rigidity under a strain in a direction perpendicularily to the plane of the shaped body, however, now had increased to 11 kg/cm$^2$, which completely corresponded to the high demands for such a rigidity under normal treatment, and the product therefore was classified as completely satisfactory.

EXAMPLE 4

This example referred to the production of a three dimensional body according to the present invention, thus no longer to a plane shaped body, and the body therefore had to be moulded. The body chosen was a diffuser for the air outlet of a ventilating system. The reason for this choice was that diffusers of the said type had earlier been produced from a material with asbestos fibers as the main constituent. In the present case, the diffuser comprised a conical body of circular cross section and with a major diameter which was essentially greater than the height. A fiber suspension was prepared from 65 parts by weight of mineral fibers, 35 parts by weight of zero fibers and 10 parts by weight of usual Kraft cellulose fibers. The amount of zero fibers is thus about 78% by weight of the total amount of cellulose fibers. The suspension also was provided with 15 parts by weight of diatomaceous earth. The suspension was diluted to a dry weight content of 2%, whereafter 5% of a 20% emulsion of polyvinyl acetate was added. The dispersion obtained was filled into a mould, produced from filtering metal cloth and was subjected thereby to successive dewatering while simultaneously adding further amounts of the dispersion, until the mould was filled with dewatered material. Then the body was removed from the mould, and thereby it had achieved a rigidity, which was sufficient for subsequent handling, comprising drying at a temperature of 90° C. until practically no water could be removed any more. After the body had cooled, it was further investigated, and thereby it was established that it had a very high rigidity in all directions, a very high resistance to erosion and attacks by moisture and also a very good mechanical workability. The surfaces, which had not been in contact with the mould, thereafter were worked, such that a well functioning diffuser was produced.

When the above mentioned tests were repeated with zero fibers of a different type, however, it proved that the result in some cases could be rather essentially different from the optimum result obtained when using pure zero fibers. The reason for this was also investigaged with the following results:

Rather often, for instance, a manufacturer of paper requires that the paper shall be dyed throughout and, thus, not just colored on its surface. Thereby it has proved convenient to mix dyestuff into the pulp mass in its wet state and before dewatering has taken place. The dye which has been dyed into the zero fibers is usually of such a small quantity, that it will seldom produce any observable inconvenience, even if such an inconvenience may exist in some cases, but much more important to the result, that when collecting the zero fibers, dye will also be collected from the dewatering liquid. This dye will therefore be contained in the amount of zero fibers, where it appears as an impurity, which may in many cases appear as the reason for the insufficiencies in the product produced according to the invention.

In this connection, it should also be mentioned that, depending upon how finely divided the cellulose material is which is used in the production of the cellulose product, and depending upon the degree of mesh dimension of the filter formed by the vira, there may also exist a variation of the mean dimension of the zero fibers. Finally, in the production of certain types of paper, cardboard and the like, other additions may be used, which are not dyestuffs but which may, nevertheless, be concentrated in the zero fibers at an undesirable level in the same way as the dyestuffs as described above.

In short, zero fibers may vary as to their dimension and as to the distribution of dimensions, and they may contain a fair amount of impurities, which are undesirable for the product produced according to the present invention.

In the tests forming basis of the present invention, it has also been established that these disadvantages may be primarily avoided by using, when there is no access to pure natural zero fibers of a homogeneous and suitable dimension, or when the costs for their collection will be too high, instead of natural zero fibers collected from the back water after the vira in a usual procedure for production of a cellulose product, another waste material from cellulose, which has not passed through but instead over the vira, and which has, for instance in connection with the sizing of the product, been cut away at its edge or the like, whereafter this material is finely ground.

By this step two different advantages are gained:

The material which has passed over the vira, if any dyestuff or any other similar product has been contained therein, always contains much less of the detrimental impurity than would be the case with zero fibers which have passed through the vira. By controlling the degree of grinding, a high rate of accuracy is achieved in determining the size of the ground fibers so that this will be rather unitary throughout the mass of synthetic zero fibers. There will be no essential increase of the material costs by this process because, of the fact that both the natural zero fibers and the synthetic zero fibers are in any case produced from a waste material, and the costs for grinding the waste fibers may be substantially within the same order of magnitude as the costs for collection of the natural zero fibers.

The investigation also determined the most suitable degree of grinding. Thereby it appeared that the grinding should take place in such a way that the ground synthetic zero fibers should have a dimension of at least 70° SR. The graduation according to the system SR is derived from the creators of this system of graduation, Schopper and Riegler. Of course, one may grind the material very much, but it has been established that grinding too much will be rather expensive and will yield a very small improvement in the final result. A practical limit for the degree of grinding has been found to be about 80° SR.

In this connection it should be mentioned that 70° SR and to a still higher degree 80° SR represent extremely high degrees of grinding, which do not normally exist within the cellulose industry for any purpose previously known.

It is obvious that one will get the best results if one uses waste fibers from the cellulose industry as raw material, which are created in such processes in which there has been no addition of dyestuff at all or in which dyestuff or other chemical products have been added to a very small extent, among which may be mentioned certain types of glue in the production of Kraft paper or the like.

Obviously, it is not necessary that all of the amount of zero fibers be formed from ground waste fibers, which have passed over but not through the vira, but in many cases it may be sufficient, that only a significant part of the zero fiber material comprises such synthetically produced zero fibers.

We claim:

1. A method for the production of a shaped fibrous body comprising the steps of:

providing an aqueous dispersion comprising mineral fibers and cellulose fibers, the amount of mineral fibers being from 30–90% by weight based on the total fiber weight and the amount of cellulose fibers being from 10 to 70% by weight, based on the total fiber weight, said cellulose fibers including from 50 to 78% of natural zero fibers, said natural zero fibers being the thin and short cellulose fibers which pass through a conventional wire in the formation of cellulose products;

dewatering the dispersion;

shaping the dewatered dispersion; and drying the dewatered and shaped dispersion to provide a shaped fibrous body.

2. A method according to claim 1 wherein the mineral fiber content is from 30 to 70% by weight based on the total weight of fibers.

3. In a shaped fibrous body comprising mineral fibers, the improvement wherein the fibrous composition of the shaped body comprises 30 to 90% mineral fibers, and from 10 to 70% by weight of cellulose fibers based on the total weight of the fibers, and wherein from 50 to 78% by weight of the cellulose fibers comprise natural zero fibers, said natural zero fibers being the thin and short cellulose fibers which pass through a conventional wire in the formation of cellulose products.

4. An improved shaped fibrous body according to claim 3 wherein the content of mineral fibers is from 30 to 70% by weight based on the weight of mineral fibers and cellulose fibers.

* * * * *